United States Patent [19]

Schechter

[11] Patent Number: 4,497,299

[45] Date of Patent: Feb. 5, 1985

[54] PLUNGER TYPE FUEL INJECTION PUMP

[75] Inventor: Michael M. Schechter, Southfield, Mich.

[73] Assignee: Ford Motor Company, Dearborn, Mich.

[21] Appl. No.: 570,556

[22] Filed: Jan. 13, 1984

[51] Int. Cl.[3] ..... F02M 41/00

[52] U.S. Cl. ..... 123/451; 123/458; 123/459; 417/516

[58] Field of Search ..... 123/451, 458, 459, 446, 123/501; 417/515, 516, 517

[56] References Cited

U.S. PATENT DOCUMENTS

| | | | |
|---|---|---|---|
| 2,745,350 | 5/1956 | Capsek | 417/516 |
| 3,648,673 | 3/1972 | Knape | 123/501 |
| 3,714,935 | 2/1973 | Dreisin | 123/501 |
| 4,241,714 | 12/1980 | Knape et al. | 123/500 |

FOREIGN PATENT DOCUMENTS

| | | | |
|---|---|---|---|
| 492377 | 2/1930 | Fed. Rep. of Germany | 123/451 |
| 952986 | 11/1956 | Fed. Rep. of Germany | 417/517 |
| WO82/04287 | 12/1982 | PCT Int'l Appl. | 123/458 |
| 99665 | 8/1940 | Sweden | 123/451 |
| 275572 | 8/1951 | Switzerland | 123/451 |

*Primary Examiner*—Magdalen Y. C. Moy

*Attorney, Agent, or Firm*—Robert E. McCollum; Clifford L. Sadler

[57] ABSTRACT

A multi-plunger fuel injection pump consisting of a number of reciprocable fuel pumping plungers to which is distributed fuel by a fuel distributor plunger, all of the plungers being actuated by a common camshaft, the number of distributor plungers being less than that of the pumping plungers and determined as a function of the operating range of the pump, the fuel flow to and from the individual pumping plungers being controlled by a solenoid operated spill control valve that is selectively operable to determine both the timing and duration of fuel injection.

8 Claims, 12 Drawing Figures

270°-360°
IVA
IVB
P1
D1
P2
P3
D2
P4

PLUNGER TYPE FUEL INJECTION PUMP

This invention relates in general to a fuel injection pump of the plunger type, and, more particularly, to one that also includes plunger type fuel distributors operated in sequence with the pumping plungers by a common engine driven camshaft.

A primary object of the invention is to provide a fuel injection pump that is relatively simple in construction and economical to manufacture. The invention accomplishes this by providing a pump of the multiple parallel plunger type including fuel distributor type plungers operated in sequence with a number of pumping plungers, the number of the distributor plungers being less than that of the pumping plungers, and all operated by a common camshaft. Reciprocation of the fuel distribution plungers supplies fuel to select ones of the pumping plungers while returning fuel to the source from others past an electromagnetically controlled spill valve that selectively determines the volume and timing of fuel pressurization.

Plunger type fuel injection pumps are known. For example, U.S. Pat. No. 4,241,714, Knape et al, shows a multi-plunger pump in which the plungers surround a single solenoid operated control valve that selectively distributes fuel to each of the plunger barrels. However, the control valve is not actuated by the engine camshaft in timed relationship with actuation of the pumping plungers, nor are there a number of fuel distribution plungers for controlling selectively the flow of fuel to a number of fuel pumping plunger pressurization chambers.

U.S. Pat. No. 3,648,673, Knape, shows a circumferentially arranged multi-plunger pump having a single centrally located helical control valve. The control valve is rotatable by the engine but not axially reciprocated to the same extent as the plungers in this invention, and the control means of the invention is much less complicated.

U.S. Pat. No. 3,714,935, Dreisin, shows an in-line multiple plunger type pump in which each plunger has its own integral control sleeve for fuel distribution that is actuated by a governing mechanism. A separate sleeve, however, is required for each plunger.

The invention overcomes the disadvantages of the prior art by providing a multiple parallel plunger pump in which part of the plungers are pumping plungers and the remainder are fuel distribution plungers, all actuated by a single engine driven camshaft, the number of fuel distribution plungers being less than that of the pumping plungers, the distribution of fuel from the pumping plungers to the fuel injectors controlled by spill valve means whose movement is controlled by electromagnetic means selectively operable to control both the volume and timing of injection.

Other objects, features and advantages of the invention will become more apparent upon reference to the succeeding detailed description thereof, and to the drawings schematically illustrating a preferred embodiment thereof; wherein, FIG. 1 schematically represents a portion of a fuel injection pump embodying the invention;

Figure 1:
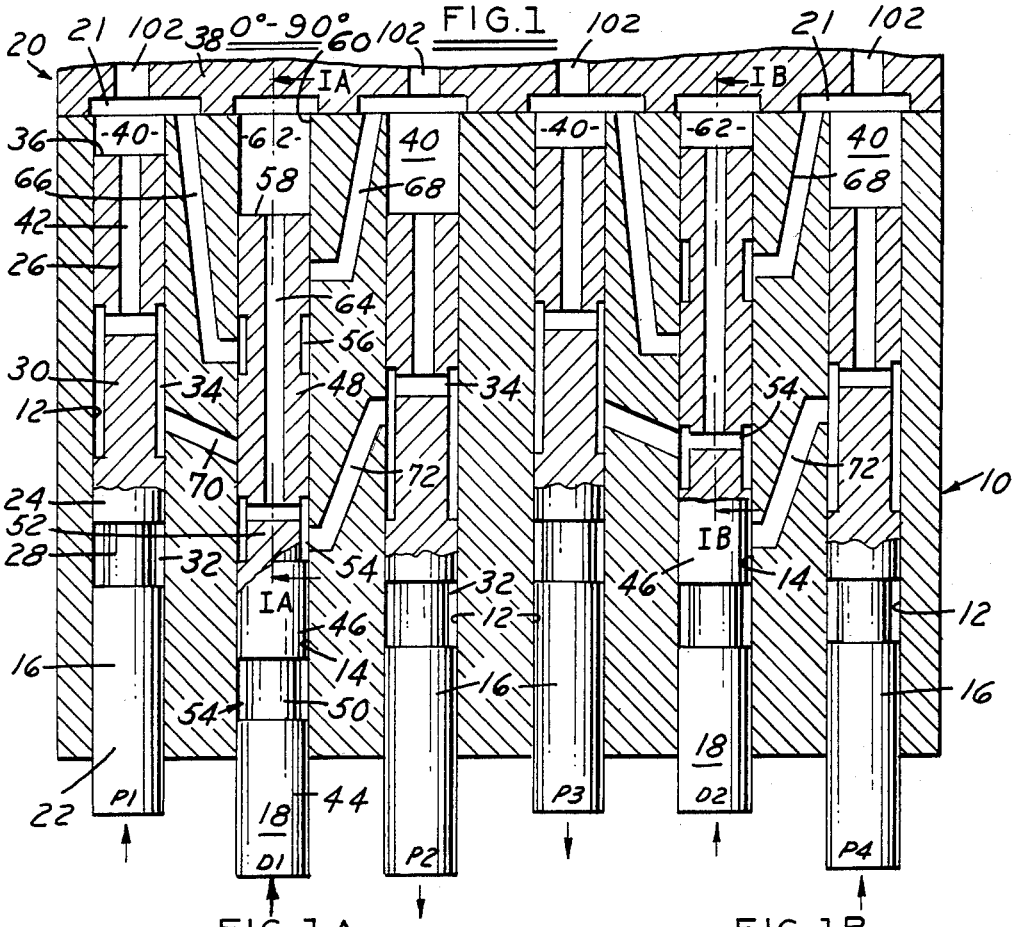
FIGS. 1A and 1B are cross-sectional views taken on planes indicated by and viewed in the direction of the arrows 1A—1A and 1B—1B, respectively, of FIG. 1.

As stated above, FIG. 1 is a schematic illustration of a portion of a fuel injection pump. It includes a housing 10 provided with four identical pumping plunger barrels 12 corresponding in number to the number of engine cylinders, and two distributor plunger barrels 14. Each of the pumping plunger barrels 12 slidably and sealingly receives therein a pumping plunger 16, all being identical in construction. For clarity of operation, the individual pumping plungers have been labeled P1, P2, P3, and P4.

Each of the distributor plunger barrels 14 slidably and sealingly receives therein a fuel distributor plunger 18, the two distributor plungers being identical in construction. Again, for clarity of operation, the distributor plungers are labeled D1 and D2. A housing cover 20, formed with a number of fuel recesses 21, closes off the upper ends of all the plunger barrels, as shown.

Each of the pumping plungers P1–P4 has land portions 22, 24, 26 interconnected by neck portions 28 and 30 of reduced diameter that define fuel annuli 32 and 34. The upper ends 36 of the plungers P1–P4 are spaced from the cover 20 to define fuel pressurization chambers 40 each connected by a central bore or passage 42 to the annulus 34.

The fuel distributor plungers D1 and D2, like pumping plungers P1–P4, each have a number of lands 44, 46 and 48 interconnected by neck portions 50 and 52 of reduced diameter to define fuel annuli 54 and 56. Again, the upper end 58 of each distributor plunger D1, D2 is spaced from the end of the barrel in which it slides to define with cover 20 a fuel chamber 62 connected by a central bore or passage 64 to the fuel annuli 54.

The pump housing further includes a number of fuel carrying passages 66, 68, 70 and 72 that interconnect adjacent plunger barrels for controlling fuel flow between the distributor and pumping plunger chambers and annuli to control the sequential operation of the pump.

More specifically, passages 66 connect the pumping plunger pressurization chambers 40 of plungers P1 and P3 to the barrels of the adjacent distributor plungers D1 and D2. Depending upon the vertical position of the distributor plunger, fuel outflow from chambers 40 of plungers P1 and P3 either will be blocked, such as indicated by the position of plunger D2 in FIG. 1, or will be connected through annuli 56, as indicated in FIG. 1 by the position of plunger D1, to a fuel spill control valve, to be described. In a similar manner, passages 68 either connect the pressurization chambers 40 for pumping plungers P2 and P4 to the barrels of the distributor plungers D1 and D2, respectively, to again either be blocked as shown in the position of the plunger D1 in FIG. 1, or connected through the annuli 56 as shown by the position of plunger D2.

Passages 70 connect fuel annuli 34 of the pumping plungers P1 and P3 at all times to the barrels of distributor plungers D1 and D2, either for blockage of a passage upon a vertical pumping stroke of a distributor plunger, to permit pressurization of the fuel in a plunger chamber 40, or for connection to the fuel source to replenish the fuel in the pumping chamber 40 on the intake stroke of the plungers, in a manner to be described.

Passages 72 on the other hand are connected at all times at one end to the fuel annuli 34 of pumping plungers P2 and P4 and at the other end to the barrel of distributor plungers D1 and D2 either to be blocked as indicated by the position of plunger D2 or to be connected to the fuel source through internal passage 64 as indicated by the position of plunger D1.

Figure 1A:
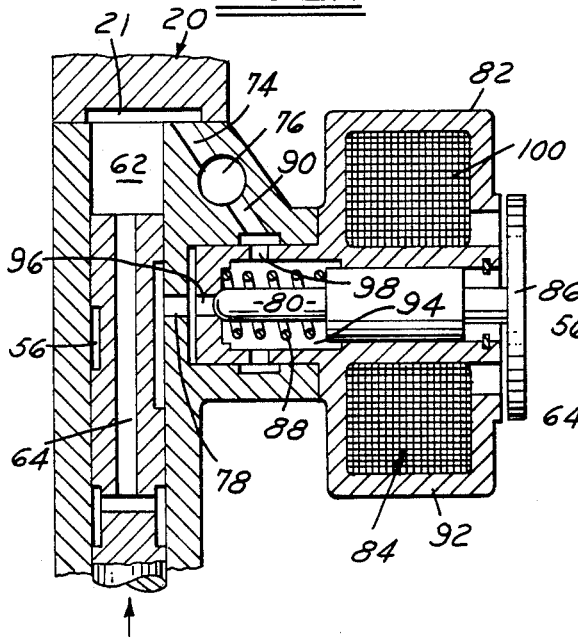
Figure 1B:
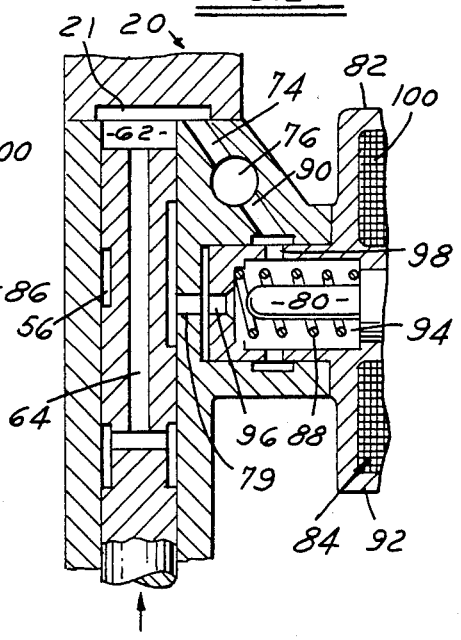

Referring now also to FIGS. 1A and 1B, the distributor plunger fuel chambers 62 are connected at all times through the cover recess 21 and passages 74 to a source of fuel under pressure in a supply gallery 76. The fuel annuli 56 of each distributor plunger D1, D2 similarly is connected to a fuel passage 78 that normally is open but can be blocked by means of a solenoid closed fuel spill control valve 80. The latter is part of an electromagnetic assembly 82 consisting of a solenoid 84 having a disc type armature 86 secured to the cylindrical extension 87 of the valve element 80 for reciprocation of the same upon energization or de-energization of the solenoid. A spring 88 normally biases the valve 80 to an open position, as indicated in FIG. 1B, allowing fuel in passage 78 to flow past the open valve 80 into a cross-passage 90 connected to the fuel supply source in gallery 76.

Assembly 82 in this case includes a housing 92 that defines a fuel chamber 94 having an inlet spill port 96 and an outlet spill passage 98 for the passage of fuel between the supply gallery 76 and fuel annuli 56. The details of construction and operation of the solenoid means 84 are not given since they are known and believed to be unnecessary for an understanding of the invention. Suffice it to say that the assembly is provided with coils 100 which when energized attract the flat platelike armature 86 for moving the same to close the valve 80.

The number of plungers that can be controlled by a single solenoid will depend upon the operational timing range of a single plunger, which will be determined by the maximum spill port closed duration plus maximum injection timing advance. If, for example, the operational range is up to 180° pump, that is, if two pumping plungers are actuated by the camshaft 180° apart, then only two plungers can be controlled by a single solenoid. Three, four or more plungers can be controlled by the same solenoid if the operating range is reduced to say 120°, 90° or less, respectively, for example. In this particular case, the operating range is 180°, and one solenoid and one distributor plunger is provided to control the fuel flow between two pumping plungers. The plungers P1, D1, P2 constitute one set or subsystem, the plungers P3, D2 and P4 constituting a second subsystem identical in every respect to the first subsystem, except for the timing of events. The first subsystem P1, D1, P2 is adapted to be actuated by the camshaft 90° crank angle behind actuation of the second subsystem P3, D2, P4. Furthermore, each of the subsystems per se operates so that the distributor plunger D1, for example, runs 90° crank angle behind the pump plunger P1 and the pump plunger P2 runs 90° behind actuation of the distributor plunger D1.

The geometric arrangement will be such that whenever the annuli 56 of the distributor plunger D1, for example, is in register with passage 66, it will be out of register with passage 68 connected to chamber 40 for plunger P2, and at the same time when the fuel annuli 54 is in register with passage 72, it will be out of register with passage 70, and vice versa.

With such an arrangement, and with proper lengths and locations of the various fuel annuli, the pressurization chamber 40 above each of the pumping plungers P1–P4 will be connected to passage 78 and disconnected from the supply gallery 76 during the up or pumping stroke of the pumping plungers, and connected to the supply gallery 76 and disconnected from passage 78 during the down or intake stroke of the pumping plungers. So long as solenoid valve 80 is deactivated and the spill port 96 is open, fuel displaced by the upward movement of the plungers P1–P4 escapes through the outlet spill passage 98 to the supply gallery 76. Activating the solenoid valve 80 closes the spill port 96 and traps the fuel inside the plunger bore 40 and, for the duration of the solenoid valve closing, the specific plunger in question displaces the fuel under injection pressure into an injection line 102 (FIG. 1) connected to cover recess 21 and leading to an individual engine cylinder. This can happen at any time during the upstroke of the pumping plunger. The duration and timing of the spill port closing will determine the amount of fuel injected and the injection timing. The electromagnetic assembly 82 in this case is adapted to be connected to a microprocessor or similar type control that will sense changes in engine operation for selective control and operation of the solenoid valve 80 both in timing of opening and closing of the valve and duration of each.

All of the pumping plungers P1–P4, as well as the two distributor plungers D1, D2 in this case are adapted to be driven by a conventional multi-lobed engine driven camshaft which, for the sake of clarity, is not shown in the drawings. Before proceeding to the operation, it should be remembered that the camshaft cams would be rotatively located so that the individual pumping plungers P1–P4 and the distributor plungers D1 and D2 will be actuated in sequence with the subsystem consisting of plungers P3, D2 and P4 actuated first, followed 90° in crank angle rotation by actuation of the subsystem consisting of plungers P1, D1 and P2. Also, it will be remembered that the plungers in each subsystem will be actuated with the distributor plunger D1, for example, being actuated 90° behind the actuation of pumping plunger P1, and pumping plunger P2 actuated a further 90° behind actuation of the distributor plunger D1. This arrangement then causes the plungers and the solenoid assembly 82 to be positioned as indicated in FIGS. 1–4 during one complete 360° camshaft rotation as follows. The four FIGS. 1–4 (and FIGS. 1A–4B) indicate the different settings of all of the plungers and solenoid valves at four different camshaft positions 90° apart, during a single revolution. Each solenoid valve 80 will be activated twice during each revolution and during each activation a different plunger will inject fuel.

Referring to FIG. 1, for example, between 0°–90° camshaft rotation, plunger P1 is moving up and fuel passage 70 is blocked by the position of distributor plunger D1, while passage 66 is connected to the blocked passage 78 shown in FIG. 1*a*. The pumping chamber 40 for plunger P1, therefore, will be pressurized to a level sufficient to open the conventional fuel delivery valve associated with injection line 102 to inject fuel into the engine cylinder.

At the same time, the pumping plunger P2 is shown on a downward or fuel intake stroke. The passage 72 and fuel annuli 34 are connected to the fuel annuli 54 of distributor plunger D1, which through central passage 64 is connected to the fuel supply in chamber 62 and therefrom to the fuel gallery 76 shown in FIG. 1*a*. The pumping plunger P3 at this time also is at the beginning of a fuel intake or downward stroke as indicated and connected to the distributor plunger D2 fuel annuli 54 to be connected to the fuel gallery 76 shown in FIG. 1*b* through the fuel chamber 62. The pumping plunger P4 has now moved toward its lowest fuel intake stroke position, ready to change to a pumping stroke, the passages 68 being connected through fuel annuli 56 to the fuel gallery 76, in FIG. 1B through the open spill control valve 80, to fill chamber 40, while passage 72 is blocked by land 46 of distributor plunger D2.

Figure 2:
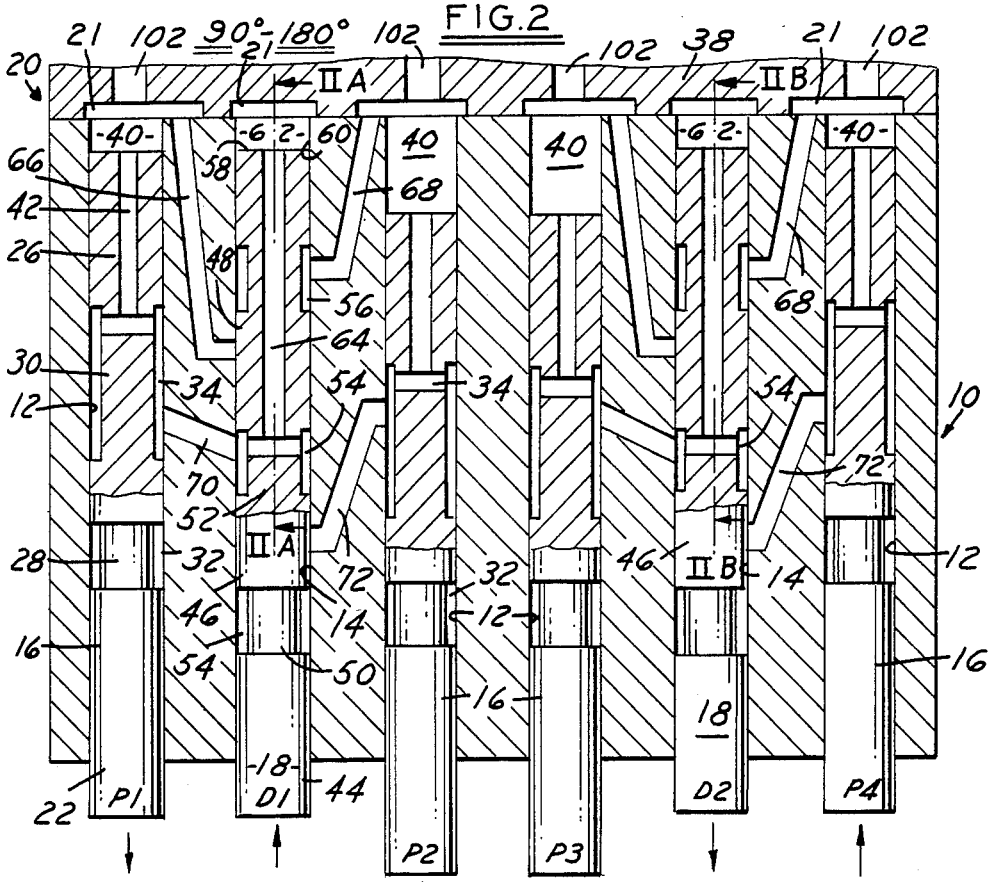
FIGS. 2, 3 and 4 are views corresponding to that of FIG. 1 illustrating the parts in different rotative positions of the engine camshaft; and, FIGS. 2A, 2B, and 3A, 3B and 4A, 4B are figures corresponding to FIGS. 1A and 1B, respectively, illustrating parts in different rotative positions of the engine camshaft corresponding to the positions of the parts in FIGS. 2, 3 and 4, respectively.
Figure 2A:
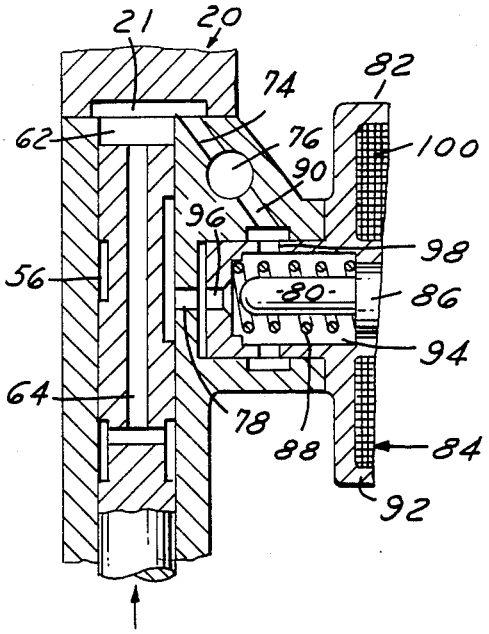
Figure 2B:
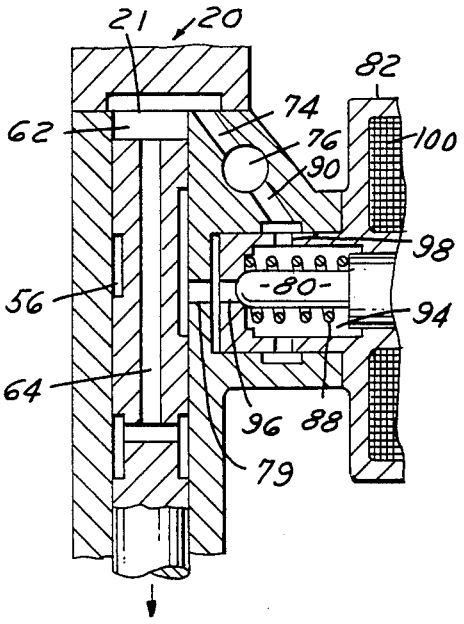

FIGS. 2, 2A and 2B indicate the positions of the parts after the camshaft has rotated 90° from the positions of the ports indicated in FIG. 1. In this case, the plunger P4 has now moved through its pumping stroke and is in the early stage of its intake stroke. Plunger P2 has moved through its intake stroke and is in the early stage of its pumping stroke. Plunger D1 has changed its position and provides proper hydraulic connections for the fuel flow into chamber 40 of plunger P1 and out of chamber 40 of plunger P2. Plunger P3 is still in its intake stroke while plunger P4 is still in its pumping stroke. The position of plunger D2 still provides proper hydraulic arrangement for plungers P3 and P4, and when passage 79 is blocked by the action of valve 80, fuel in chamber 40 of plunger P4 will be pressurized and injected into a corresponding engine cylinder.

Figure 3:
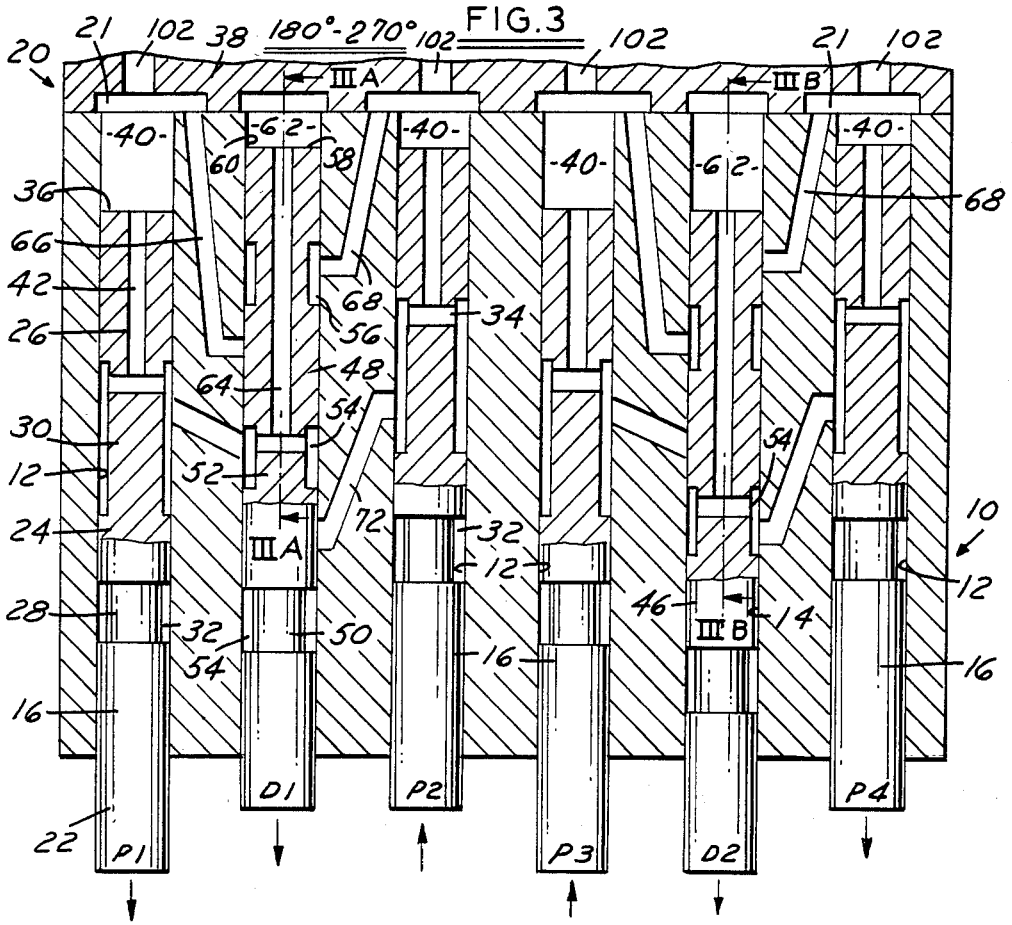
Figure 3A:
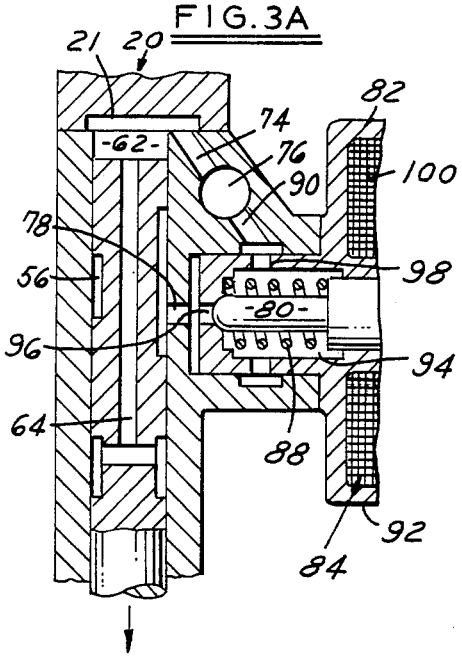
Figure 3B:
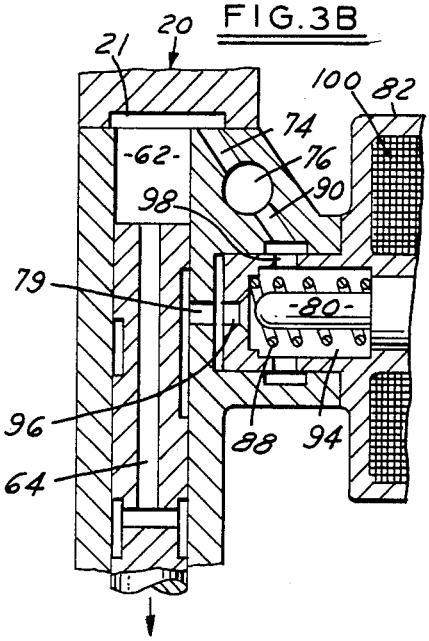
Figure 4:
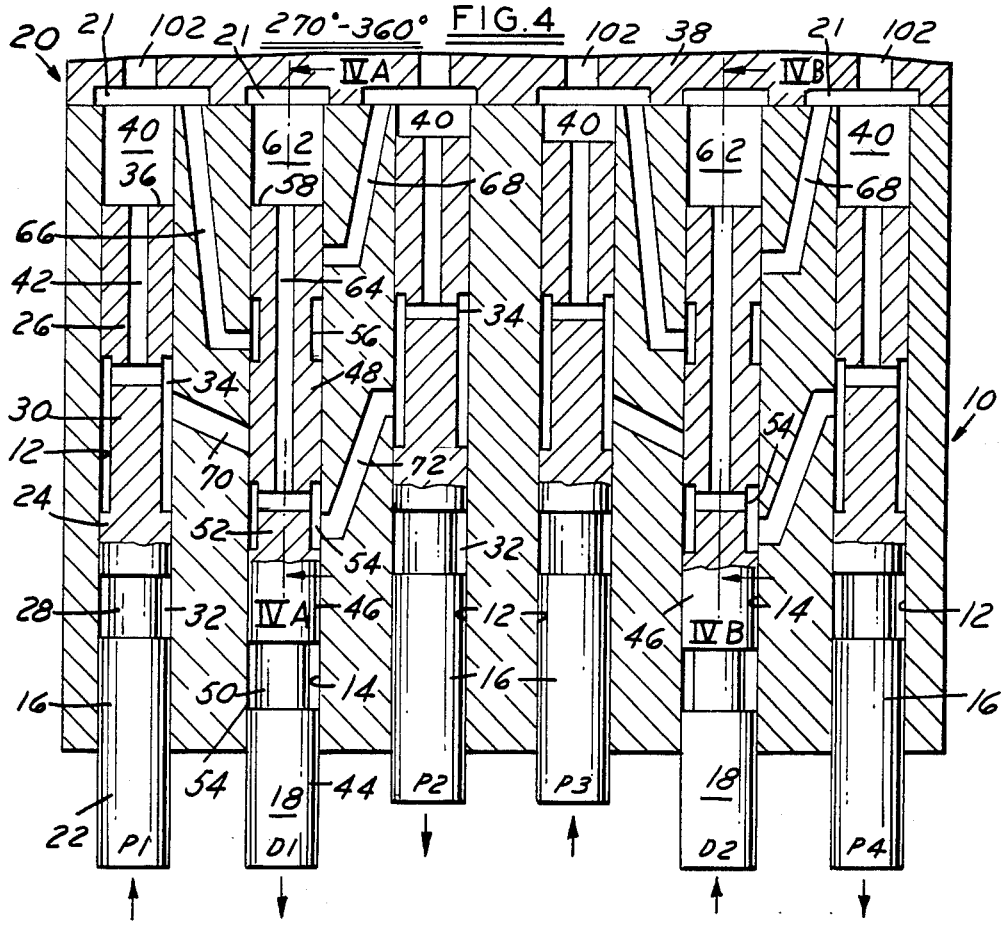
Figure 4A:
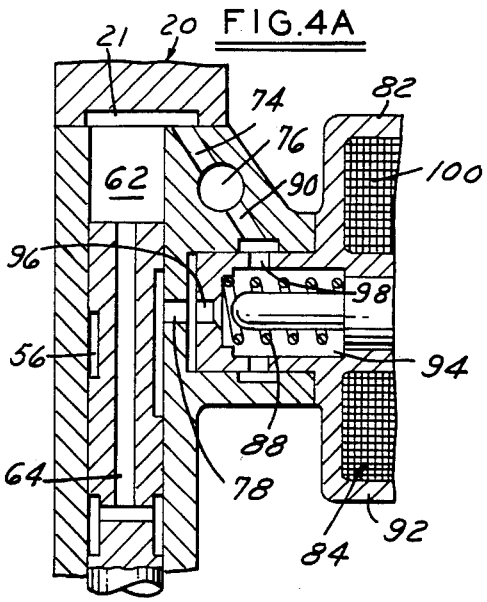
Figure 4B:
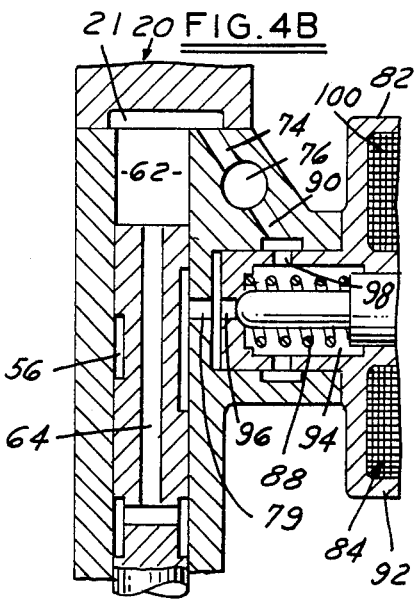

A similar sequence of events occurs upon rotation of the camshaft another 90° and then a further 90° until a complete cycle is completed, to position the ports as shown in FIGS. 3 and 4, respectively. During each 90° rotation, only one pumping plunger will be actuated to inject fuel into the particular engine cylinder.

It will be clear from the foregoing that with a suitable arrangement of internal passages and fuel annuli on the plungers, a single solenoid can be connected during each revolution of the camshaft with two, three, four or even larger number of pumping plungers, thus further reducing the number of solenoid valves required to control a multiplunger pump. It will also be seen that with the identical construction of the pumping plungers, a likewise identical construction of the distributor plungers, and the solenoid control of the spill valve, that a simplified construction of a multi-plunger pump can be made and that only a single camshaft need be provided to actuate all of the pumping and fuel distribution plungers, thus providing an economical construction.

While the invention has been shown and described in its preferred embodiments, it will be clear to those skilled in the arts to which it pertains that many changes and modifications may be made thereto without departing from the scope of the invention.

I claim:

1. A fuel injection pump of the plunger type for an automotive type internal combustion engine, the pump having a plurality of fuel pumping plungers corresponding in number to the number of engine cylinders and each mounted for a reciprocatory movement in a plunger barrel through a fuel pumping stroke in one direction and a fuel intake stroke in the opposite direction, a number of fuel distribution plungers having a source of fuel under pressure connected thereto, the latter number being less than the number of pumping plungers, the distribution plungers also being reciprocably mounted in a plunger barrel for movement between fuel supply positions alternately supplying certain ones of the pumping plungers separately with fuel during the pumping intake stroke of the respective plunger while blocking the return flow of fuel from other pumping plungers during the pumping stroke of the respective pumping plunger, and vice versa, as a function of the position of the distributor plunger, the pumping and distribution plungers all being adapted to be reciprocated in timed relationship to one another by a common engine driven camshaft, each of the plunger barrels defining a fuel chamber at one end for pressurization of the fuel in the pumping plunger chamber during the plunger pumping stroke and for the intake of fuel thereto during the return intake stroke of the plunger, a number of open/closed fuel spill control valve means associated with and equal in number to the distribution plungers, passage means connecting fuel from the distribution plunger fuel chambers to each of the pumping plunger chambers past the spill valve means and back again through the fuel distribution plungers to the source, and electromagnet means operable selectively in timed relationship to reciprocatory movement of the plungers to open and close the spill valve means to control the return of fuel to the source and the pressurization of fuel in the pumping plunger chambers.

2. A pump as in claim 1, wherein the fuel distribution plungers are actuated by the camshaft subsequent to actuation of one of the pumping plungers fuel connected thereto, and in advance of the camshaft actuation of a second pumping plunger fuel connected thereto.

3. A pump as in claim 2, wherein a number of fuel pumping plungers and one fuel distribution plunger constitute a subset, each subset of plungers being actuated by the camshaft in sequence a predetermined crank angle number of degrees behind the last previously actuated subset.

4. A pump as in claim 3, wherein the fuel distribution and pumping plungers in each subset are camshaft actuated in the same sequence relative to one another as in all other subsets.

5. A pump as in claim 1, wherein all of the plungers are radially arranged for actuation by the common camshaft, and the longitudinal axis of all plungers are parallel.

6. A pump as in claim 1, wherein the electromagnet means comprises a solenoid, the spill valve means including a slidable valve spring biased to an open position and moved to a closed position blocking return flow of fuel to the source to permit the pressurization of the pumping plunger chambers.

7. A pump as in claim 6, the solenoid being selectively energizable to selectively control the volume and timing of fuel returned to the source past the spill valve.

8. A pump as in claim 7, wherein each of the pumping chambers is connected to a fuel discharge passage adapted to be closed by a pressure relief type valve openable above a predetermined pressure in the chamber to deliver fuel to the engine cylinders.

* * * * *